US006701813B2

(12) United States Patent
Hu

(10) Patent No.: US 6,701,813 B2
(45) **Date of Patent: *Mar. 9, 2004**

(54) WRENCH WITH A FIXED MAXIMUM OPERATIONAL TORQUE

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 75 days.

This patent is subject to a terminal disclaimer.

(21) Appl. No.: 10/041,731

(22) Filed: Jan. 7, 2002

(65) Prior Publication Data

US 2003/0079577 A1 May 1, 2003

(30) Foreign Application Priority Data

Oct. 29, 2001 (TW) ..... 90218719 U

(51) Int. Cl.[7] ..... B25B 23/14
(52) U.S. Cl. ..... 81/467; 81/473
(58) Field of Search ..... 81/467, 473–476

(56) References Cited

U.S. PATENT DOCUMENTS

| | | | | | |
|---|---|---|---|---|---|
| 2,157,574 | A | | 5/1939 | Siesel | 464/35 |
| 2,300,652 | A | | 11/1942 | Cooney | 81/483 |
| 2,332,971 | A | | 10/1943 | Johnson | 81/480 |
| 2,396,027 | A | | 3/1946 | Spayd | 81/480 |
| 2,601,044 | A | | 6/1952 | Mayer | 81/480 |
| 2,768,547 | A | | 10/1956 | Noell | 81/480 |
| 2,826,107 | A | | 3/1958 | Woods | 81/480 |
| 2,924,134 | A | * | 2/1960 | Harmes | 81/467 |
| 2,972,271 | A | | 2/1961 | Gill | 81/480 |
| 3,593,542 | A | | 7/1971 | Urayama | 464/37 |
| 3,651,718 | A | | 3/1972 | Thomasian | 81/480 |
| 4,238,978 | A | | 12/1980 | Leone | 81/480 |
| 4,308,770 | A | | 1/1982 | MacDonald | 81/177.2 |
| 5,152,200 | A | | 10/1992 | Kaplan | 81/467 |
| 5,822,830 | A | | 10/1998 | Lin | 16/422 |
| 6,029,551 | A | * | 2/2000 | Wu | 81/475 |
| 6,076,439 | A | * | 6/2000 | Dzieman | 81/473 |
| 6,155,147 | A | | 12/2000 | Dzieman | 81/473 |
| 6,439,086 | B1 | | 8/2002 | Bahr | 81/467 |
| 6,487,943 | B1 | * | 12/2002 | Jansson et al. | 81/475 |
| 6,502,483 | B1 | | 1/2003 | Swank et al. | 81/437 |
| 2003/0010162 | A1 | | 1/2003 | Hu | 81/437 |
| 2003/0010163 | A1 | | 1/2003 | Hu | 81/437 |
| 2003/0079578 | A1 | | 5/2003 | Hu | 81/437 |
| 2003/0079579 | A1 | | 5/2003 | Hu | 81/437 |
| 2003/0205114 | A1 | | 11/2003 | Hu | |
| 2003/0205115 | A1 | | 11/2003 | Hu | |

* cited by examiner

*Primary Examiner*—Lee D Wilson
(74) *Attorney, Agent, or Firm*—Alan Kamrath; Rider Bennett, LLP

(57) ABSTRACT

A wrench comprises a rod, a retainer, a pressing member, and a casing for accommodating the retainer and allowing relative pivotal movement between the casing and the retainer. The pressing member is received in the casing and slidable along a longitudinal direction of the rod. The pressing member is biased to press against two ends of the retainer, thereby exerting an engaging force between each of two ends of the retainer and an associated one of the ends of the pressing member. When a rotational force applied to the casing is smaller than the engaging force, the retainer and the rod are turned to thereby turn the fastener. When a rotational force applied to the casing is greater than the engaging force, the casing and the pressing member slide while the retainer and the rod are not turned.

27 Claims, 15 Drawing Sheets

WRENCH WITH A FIXED MAXIMUM OPERATIONAL TORQUE

BACKGROUND OF THE INVENTION

1. Field of the Invention

The present invention relates to a wrench with a fixed maximum operational torque to prevent damage to the object secured by a fastener driven by the wrench.

2. Description of the Related Art

FIG. 15A of the drawings illustrates a conventional wrench 1 having a hexagonal driving portion with six planar faces 2 for engaging with six faces of a hexagonal groove in a top face of a fastener. However, slide tends to occur between the planar faces 2 of the driving portion of the conventional wrench 1 and the faces of the fastener. FIG. 15B illustrates a so-called TROX wrench 3 having plural arcuate faces 4 for engaging with corresponding arcuate faces in a top face of a fastener. Such a TROX wrench 3 is used to tighten important parts of a cars and cutting tools. As illustrated in FIG. 16, a blade 7 is tightened to a cutting tool 5 by a bolt 6. However, the expensive blade 7 tends to be damaged when the bolt 6 is excessively tightened. But the blade 7 could fly away and thus cause injury if the bolt 6 is not tightened to the desired extent.

SUMMARY OF THE INVENTION

An object of the present invention is to provide a wrench with a fixed maximum operational torque such that when the torque applied by the user is greater than the maximum operational torque, the wrench slides and the fastener is not turned. Thus, damage to the object secured by the fastener resulting from over-tightening is prevented.

Another object of the present invention is to provide a wrench with a fixed maximum operational torque that can be altered in response to the actual use.

In accordance with the present invention, a wrench comprises a rod, a retainer, a pressing member, and a casing for accommodating the retainer and allowing relative pivotal movement between the casing and the retainer. The pressing member is received in the casing and slidable along a longitudinal direction of the rod. The pressing member is biased to press against two ends of the retainer, thereby exerting an engaging force between each of two ends of the retainer and an associated one of the ends of the pressing member. When a rotational force applied to the casing is smaller than the engaging force, the retainer and the rod are turned to thereby turn the fastener. When a rotational force applied to the casing is greater than the engaging force, the casing and the pressing member slide while the retainer and the rod are not turned.

Other objectives and novel features of the invention will become more apparent from the following detailed description when taken in conjunction with the accompanying drawings.

DETAILED DESCRIPTION OF THE PREFERRED EMBODIMENTS

Figure 1:
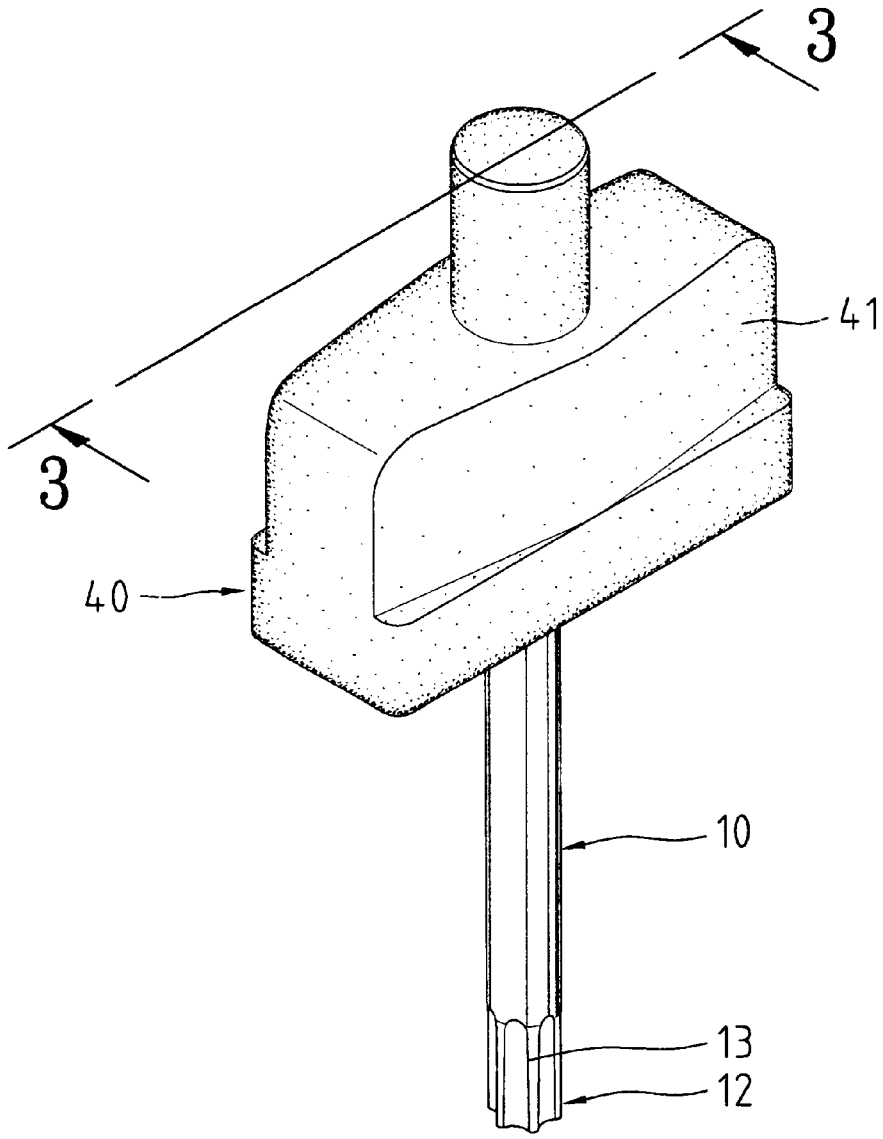
FIG. 1 is a perspective view of a wrench in accordance with the present invention.
Figure 2:
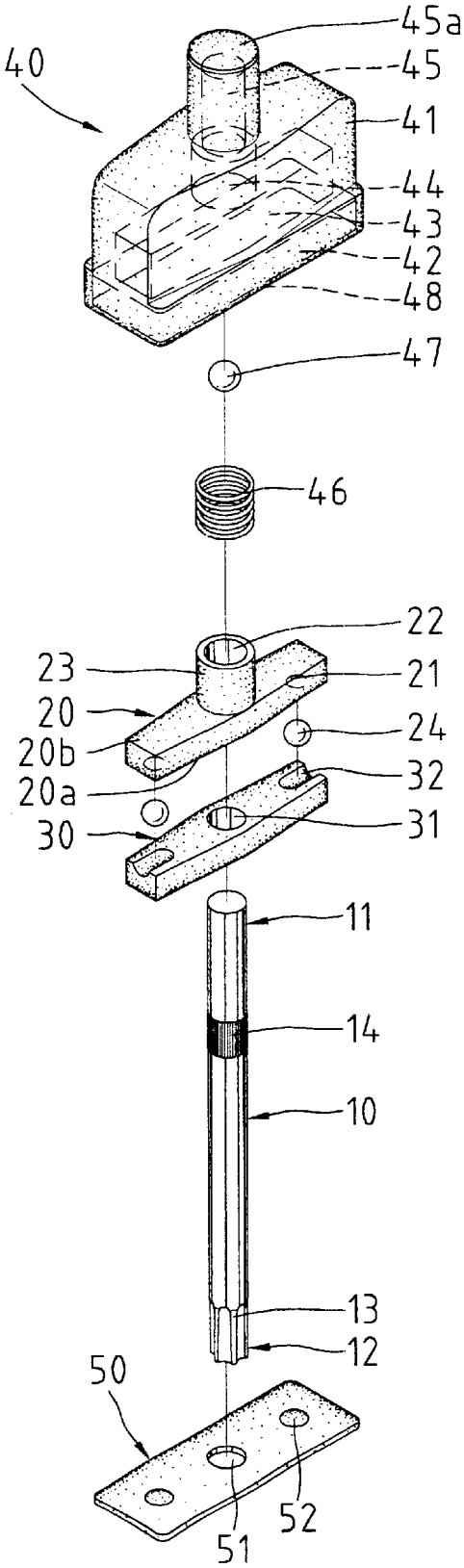
FIG. 2 is an exploded perspective view of the wrench in accordance with the present invention.

Referring to FIGS. 1 and 2, a wrench in accordance with the present invention generally includes a rod 10, a pressing member 20, a retainer 30, and a casing 40. The rod 10 comprises a first end 11 and a second end 12 with a driving portion 13 for engaging with a fastener. In this embodiment, the driving portion 13 is shaped as a TROX type wrench. The rod 10 further has an embossed section 14 that is preferably adjacent to the first end 11 thereof.

The pressing member 20 includes a first side 20*a* having a groove 21 in each of two ends thereof and a second side 20*b*. An extension 23 projects from a center of the second side 20*b*. A through-hole 22 extends through the extension 23 and the pressing member 20.

The retainer 30 includes a hole 31 in a center thereof for securely engaging with the embossed section 14 of the rod 10. Thus, the retainer 30 and the rod 10 rotate jointly. The retainer 30 further includes a groove 32 in each of two ends thereof.

Figure 3:
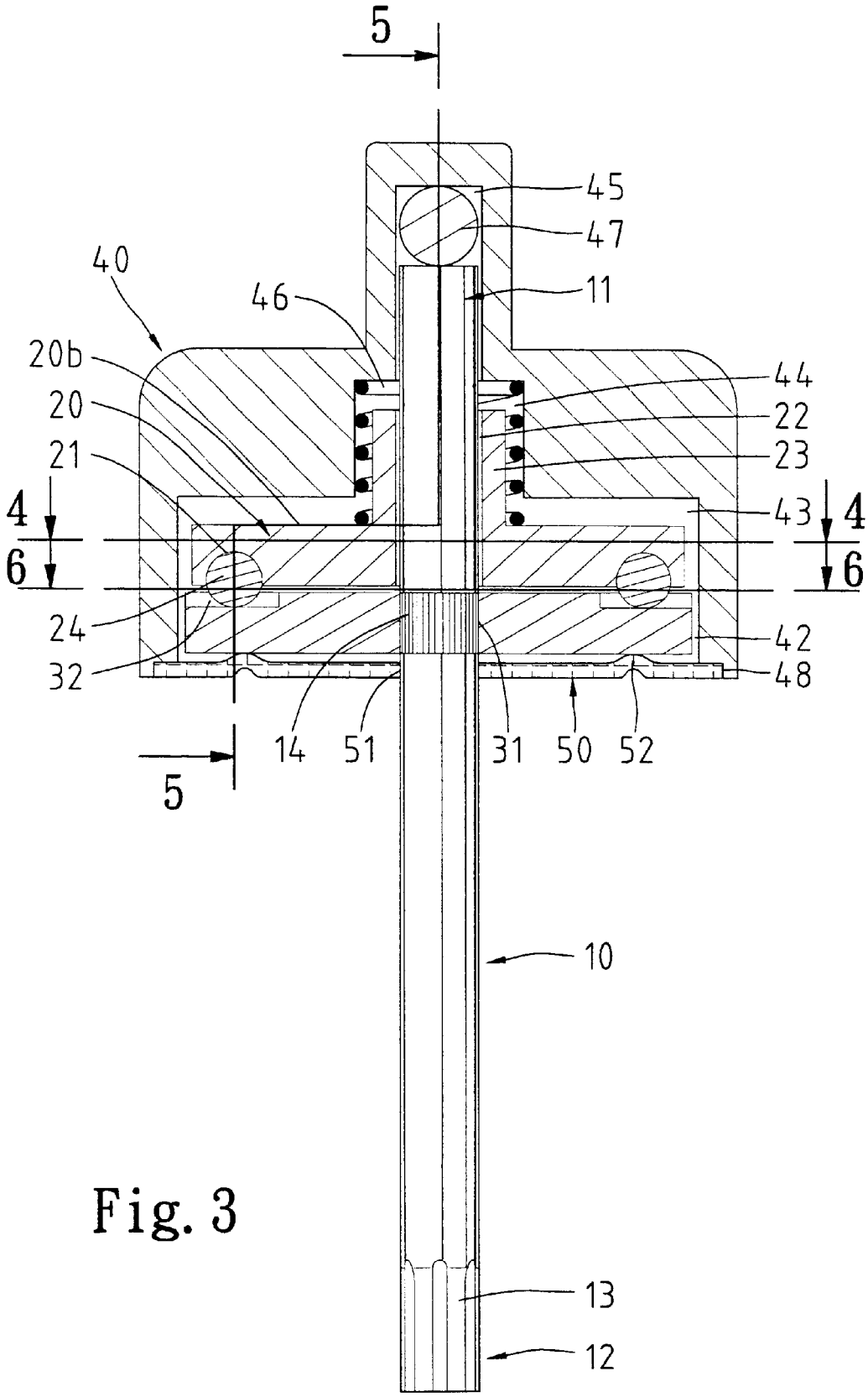
FIG. 3 is a sectional view taken along plane 3—3 in FIG. 1.

The casing 40 comprises a grip portion 41 for manual turning operation. A receiving section 42 is defined in the casing 40 for accommodating the retainer 30 while allowing relative rotational movement between the casing 40 and the retainer 30. Referring to FIGS. 2 and 3, the pressing member 20 is slidably received in a compartment 43 that is located above the receiving section 42. A positioning hole 45 is defined in the center of casing 40 and communicated with the compartment 43 and the receiving section 42. The rod 10 is extended through the receiving section 42 and the compartment 43 with the first end 11 of the rod 10 being received in the positioning hole 45 of the casing 40. A ball 47 is provided between an end face of the first end 11 of the rod 10 and an end wall defining a portion of the positioning hole 45 of the casing 40 to provide a smooth rotation therebetween. The positioning hole 45 includes an enlarged section 44 for receiving the extension 23 of the pressing member 20.

Biasing means is provided to urge the pressing member 20 to press against the retainer 30. In this embodiment, an elastic element 46 is mounted around the extension 23 with an end of the elastic element 46 being attached to an end face defining the enlarged section 44 and with the other end of the elastic element 46 being attached to the second side 20*b* of the pressing member 20. An engaging member (e.g., a ball 24) is provided between each groove 21 of the pressing member 20 and an associated one of the grooves 32 of the retainer 30. A recessed portion 48 surrounds the receiving section 42 of the casing 40. In this embodiment, a cylindrical member 45*a* projects from a side of the casing 40 and defines a portion of the positioning hole 45 that receives the first end 11 of the rod 10 and the ball 47, best shown in FIG. 3.

A lid 50 is securely mounted in the recessed portion 48 of the casing 40 to close the casing 40. The lid 50 includes a hole 51 through which the rod 10 extends. The lid 50 further includes two protrusions 52 respectively on two ends thereof. The two ends of the retainer 30 are slidably supported by the protrusions 52.

Figure 4:
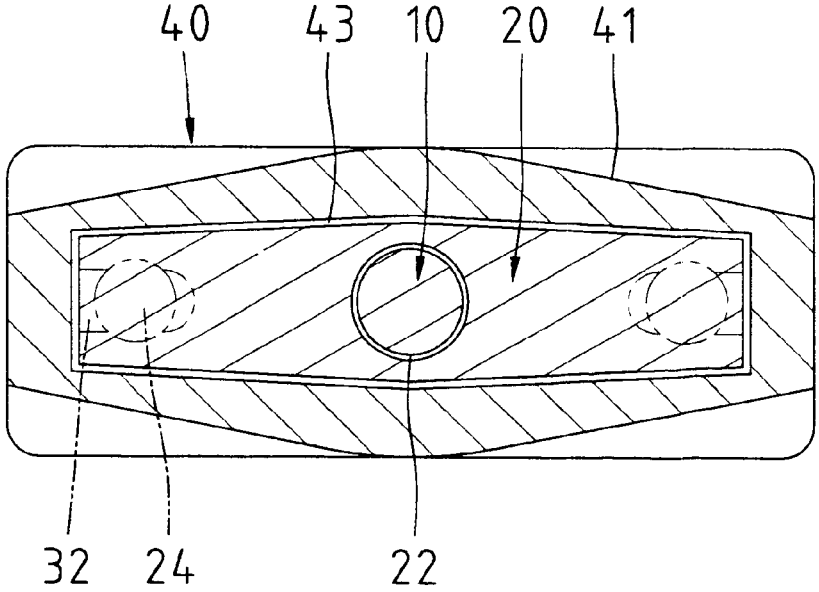
FIG. 4 is a sectional view taken along plane 4—4 in FIG. 3.
Figure 5:
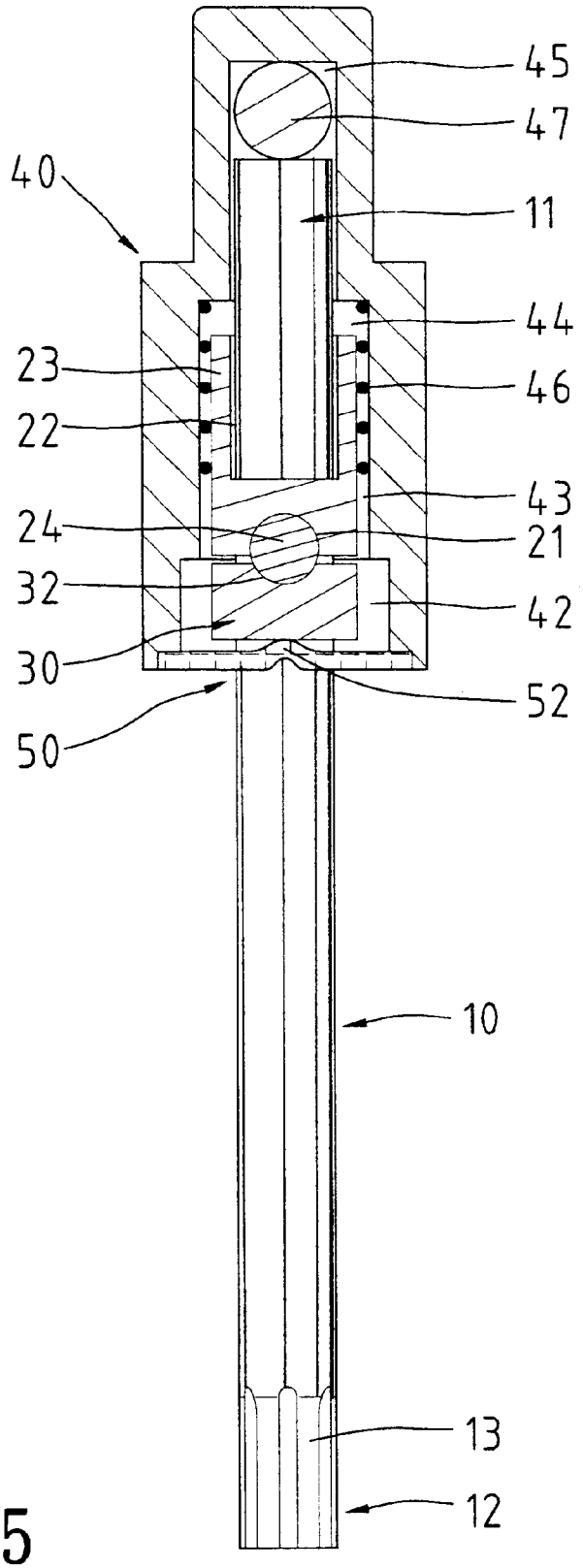
FIG. 5 is a sectional view taken along plane 5—5 in FIG. 3.
Figure 6:
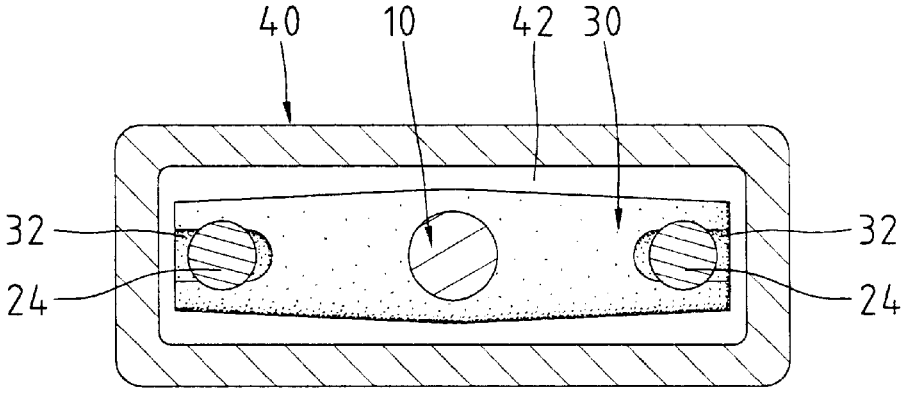
FIG. 6 is a sectional view taken along plane 6—6 in FIG. 3.

Referring to FIGS. 3 through 5, the pressing member 20 is biased by the elastic element 46 to slide along a longitudinal direction of the rod 10. Thus, each ball 24 is moved to press against a bottom wall defining the associated groove 32 of the retainer 30. Namely, a predetermined engaging force exists between each bottom wall defining the associated groove 32 of the retainer 30 and the associated ball 24 under the action of the elastic element 46. The pressing member 20 turns together with the casing 40 when the latter is turned.

When driving a TROX type bolt (not shown) for a cutting tool (not shown), the driving portion 13 of the second end 12 of the rod 10 is engaged with the bolt, and the casing 40 is then turned by means of gripping and turning the grip portion 41. Referring to FIGS. 3 and 5, when the rotational force applied to the wrench is smaller than the predetermined engaging force between each bottom wall defining the groove 32 of the retainer 30 and the associated ball 24, the retainer 30 and the rod 10 turn together with the casing 40 to thereby drive the bolt.

Figure 8:
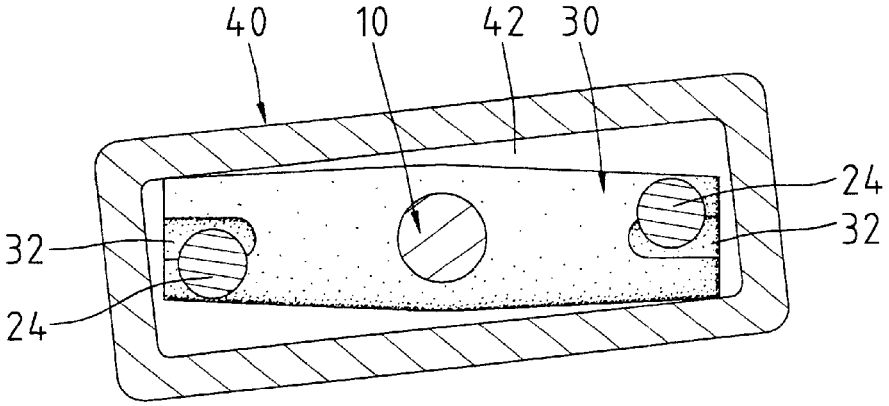
FIG. 8 is a view similar to FIG. 6, illustrating operation of the wrench in accordance with the present invention.
Figure 7:
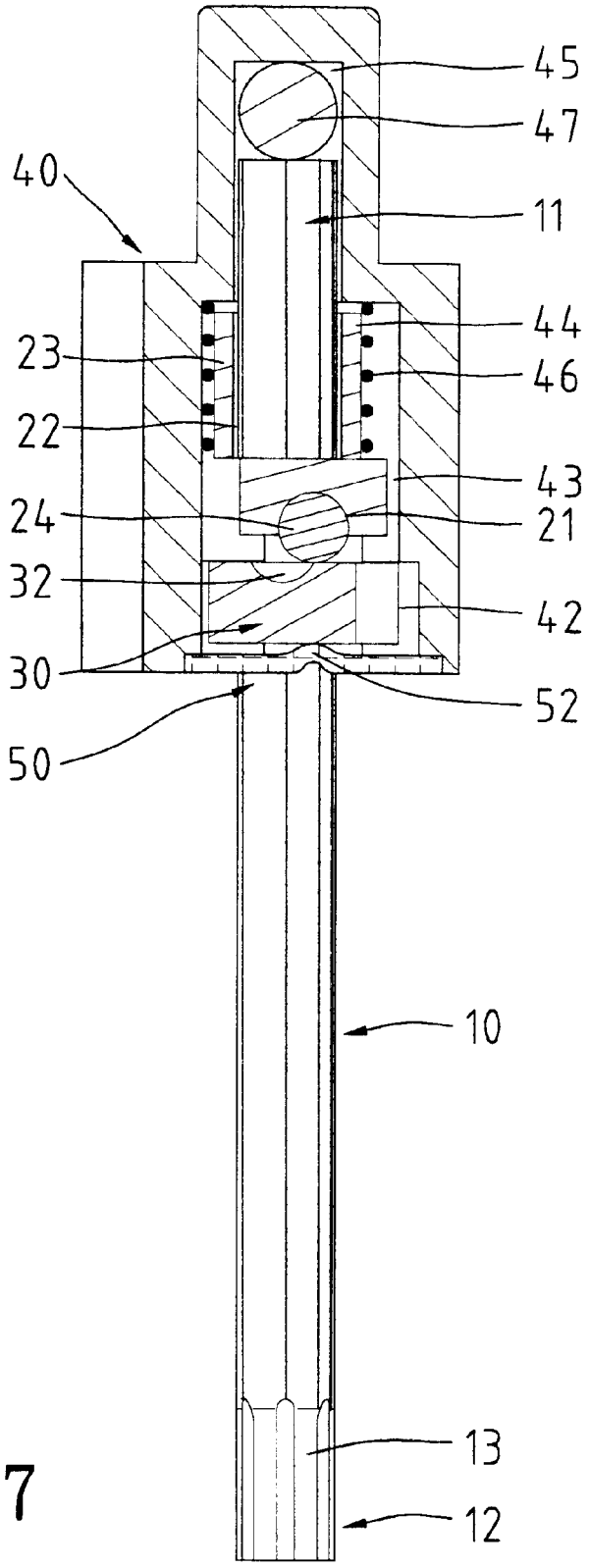
FIG. 7 is a view similar to FIG. 5, illustrating operation of the wrench in accordance with the present invention.

When the rotational force applied to the wrench is greater than the predetermined engaging force between each bottom wall defining the associated groove 32 of the retainer 30 and the ball 24, as illustrated in FIGS. 7 and 8, the elastic element 46 is compressed to absorb the excessive amount of rotational force. Since elastic element 46 is compressed, a sliding action is generated between each ball 24 and the bottom wall defining the associated groove 32 of the retainer 30. Each ball 24 is thus disengaged from the associated groove 32 of the retainer 30, and the casing 40 and the pressing member 20 slide relative to the retainer 30; namely, the retainer 30 and the rod 10 are not turned. As a result, the bolt is not turned. The casing 40 and the pressing member 20 return to their original positions shown in FIGS. 3 and 5 under the action of the elastic element 46 when the rotational force is released. The protrusions 52 of the lid 50 allow smooth relative rotational movement between the casing 40 and the retainer 30.

It is noted that the engaging force, which largely depends on the elastic coefficient of the elastic element 46, determines a maximum operational torque for turning the rod 10. Namely, when the torque applied to the casing 40 is smaller than the maximum operational torque, the retainer 30 and the rod 10 are turned, and when the torque applied to the casing 40 is greater than the maximum operational torque, the retainer 30 and the rod 10 are not turned. During tightening of the bolt, the bolt before being tightened is turned by means of applying a torque smaller than the maximum operational torque. When the bolt is tightened, the torque required to turn the casing 40 would be greater than the maximum operational torque such that the casing 40 slides. Thus, the user will notice the sliding motion of the casing 40 and be aware of tightening of the bolt. Damage to the bolt and the cutting tool resulting from over-tightening is avoided. The maximum operational torque can be altered by means of selecting elastic elements 46 of different elastic coefficients. The maximum operational torque is a constant and thus allows accurate operation. This advantageous design can be used in a limited space, and the manufacturing cost of the wrench is largely reduced. This advantageous design can be used in a limited space, and the manufacturing cost of the wrench is largely reduced.

FIGS. 9 through 12 illustrate a modified embodiment of the wrench in accordance with the present invention. Structure of this embodiment is the identical to that of the first embodiment, except that the balls 24 and the grooves 21 in the first embodiment are replaced by protrusions 25 integrally formed on two ends of the first side 20*a* of the pressing member 20.

Figure 10:
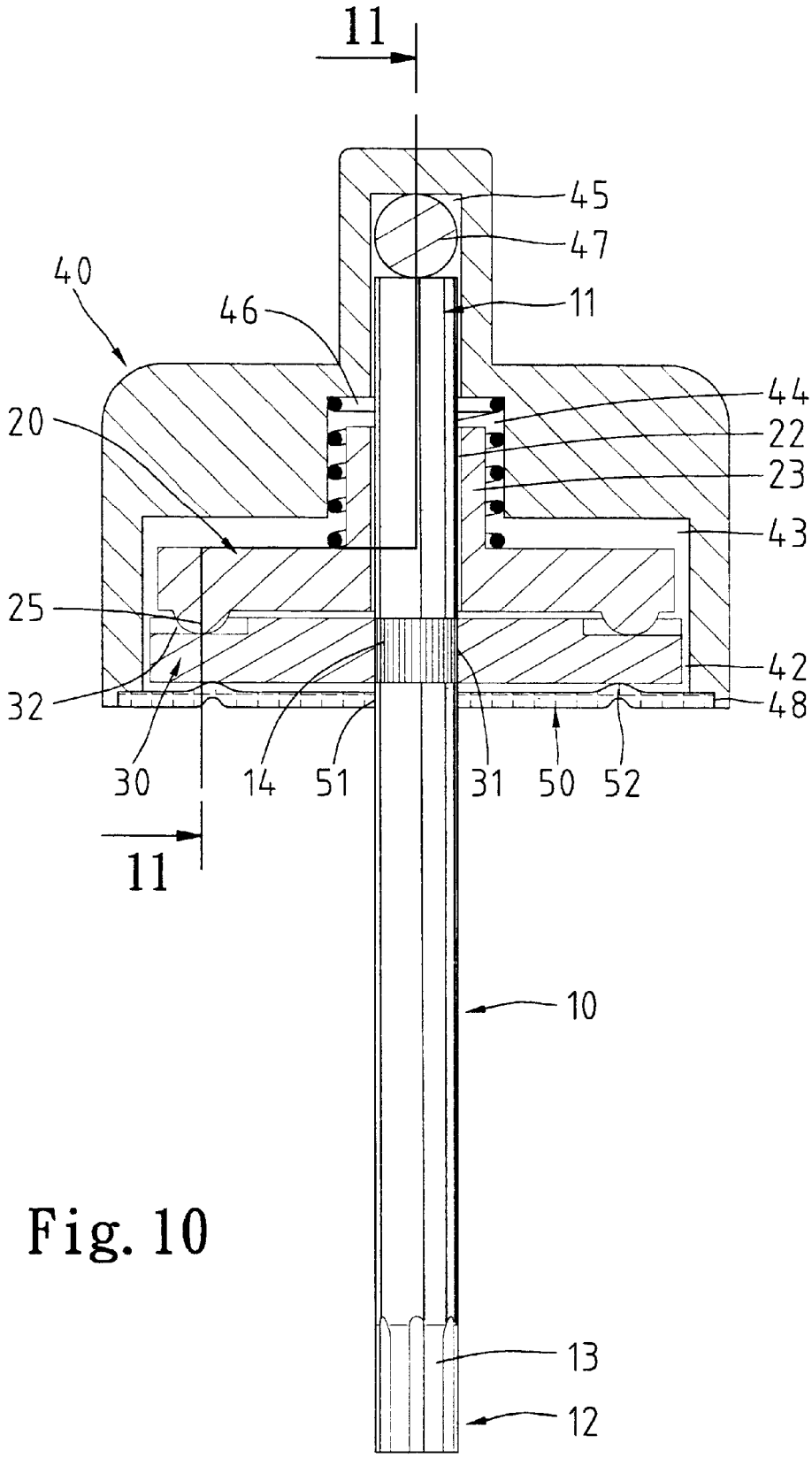
FIG. 10 is a sectional view of the modified embodiment of the wrench in FIG. 9.
Figure 11:
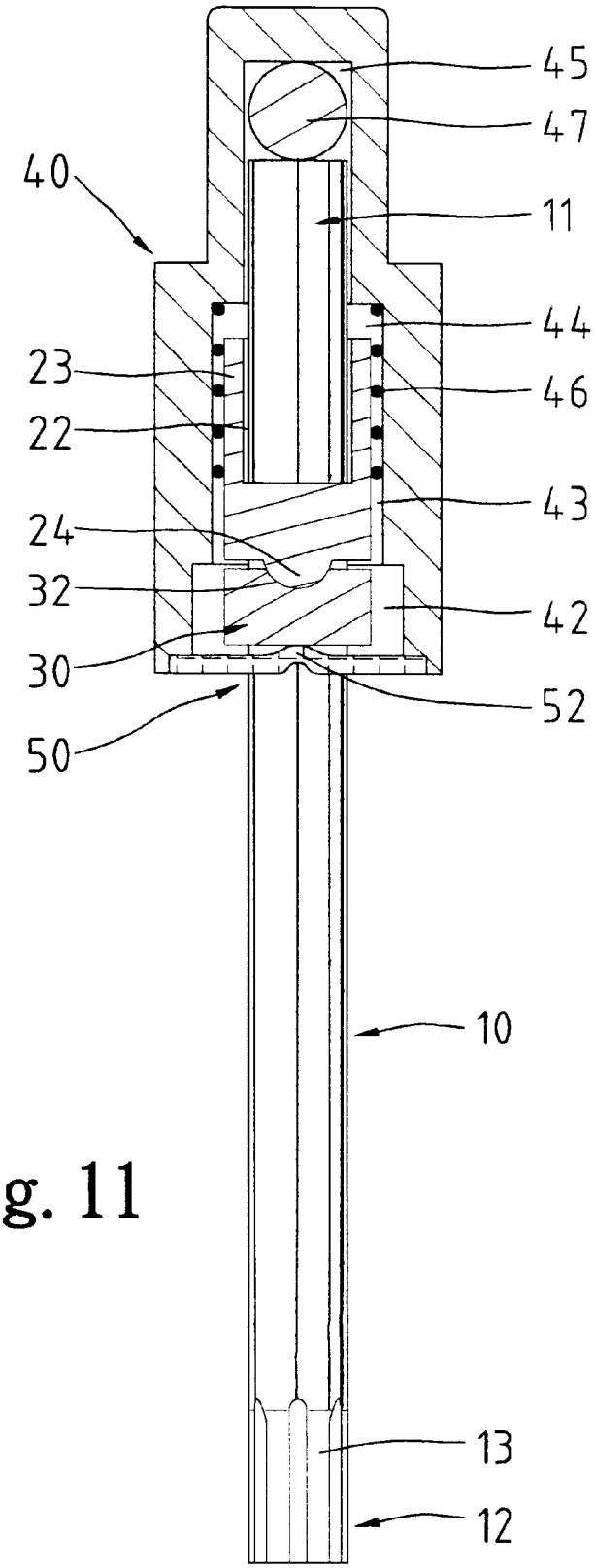
FIG. 11 is a sectional view taken along plane 11—11 in FIG. 10.

Referring to FIGS. 10 and 11, the pressing member 20 is biased by the elastic element 46 to slide along a longitudinal direction of the rod 10. Thus, each protrusion 25 presses against a bottom wall defining the associated groove 32 of the retainer 30. Namely, a predetermined engaging force exists between each bottom wall defining the associated groove 32 of the retainer 30 and the associated protrusion 25 under the action of the elastic element 46.

When driving a TROX type bolt (not shown) for a cutting tool (not shown), the driving portion 13 of the second end 12 of the rod 10 is engaged with the bolt, and the casing 40 is then turned by means of gripping and turning the grip portion 41. Referring to FIGS. 10 and 11, when the rotational force applied to the wrench is smaller than the predetermined engaging force between each bottom wall defining the groove 32 of the retainer 30 and the associated protrusion 25, the retainer 30 and the rod 10 turn together with the casing 40 to thereby drive the bolt.

Figure 12:
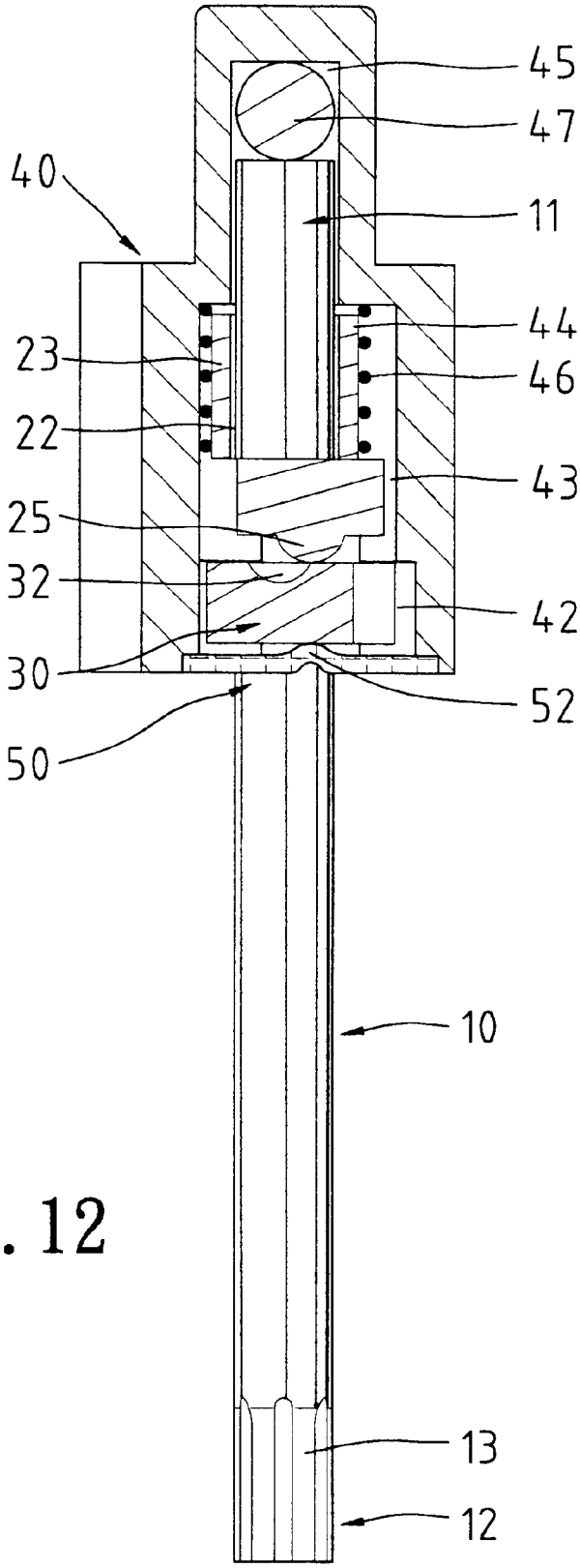
FIG. 12 is a sectional view similar to FIG. 11, illustrating operation of the wrench of FIG. 9.
Figure 13:
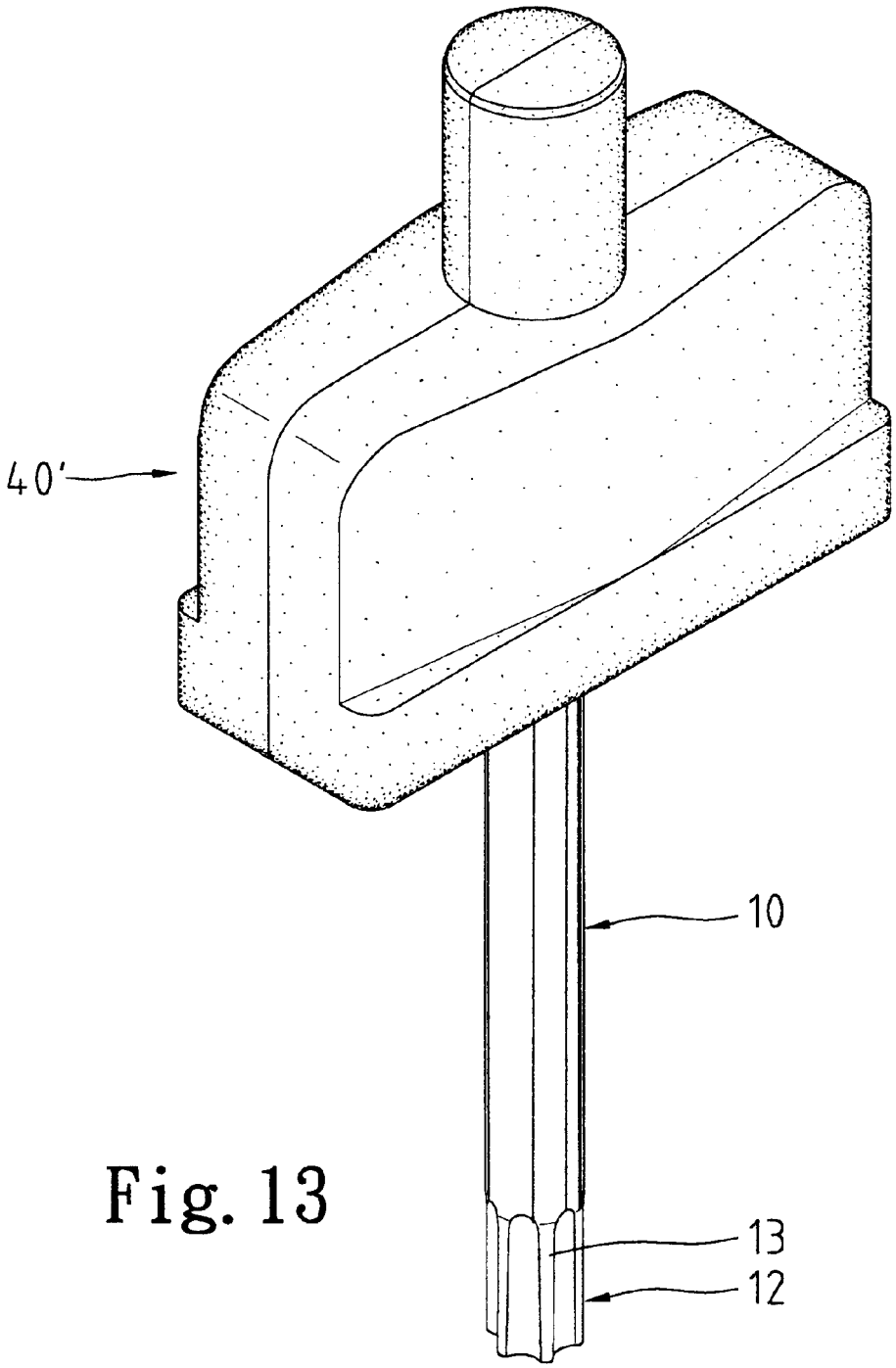
FIG. 13 is a perspective view of another modified embodiment of the wrench in accordance with the present invention.

When the rotational force applied to the wrench is greater than the predetermined engaging force between each bottom wall defining the associated groove 32 of the retainer 30 and the ball 24, as illustrated in FIG. 12, the elastic element 46 is compressed to absorb the excessive amount of rotational force. Since elastic element 46 is compressed, a sliding action is generated between each protrusion 25 and the bottom wall defining the associated groove 32 of the retainer 30. Each protrusion 25 is thus disengaged from the associated groove 32 of the retainer 30, and the casing 40 and the pressing member 20 slide relative to the retainer 30; namely, the retainer 30 and the rod 10 are not turned. As a result, the bolt is not turned. The casing 40 and the pressing member 20 return to their original positions shown in FIGS. 10 and 11 under the action of the elastic element 46 when the rotational force is released. The protrusions 52 of the lid 50 allow smooth relative rotational movement between the casing 40 and the retainer 30.

Figure 14:
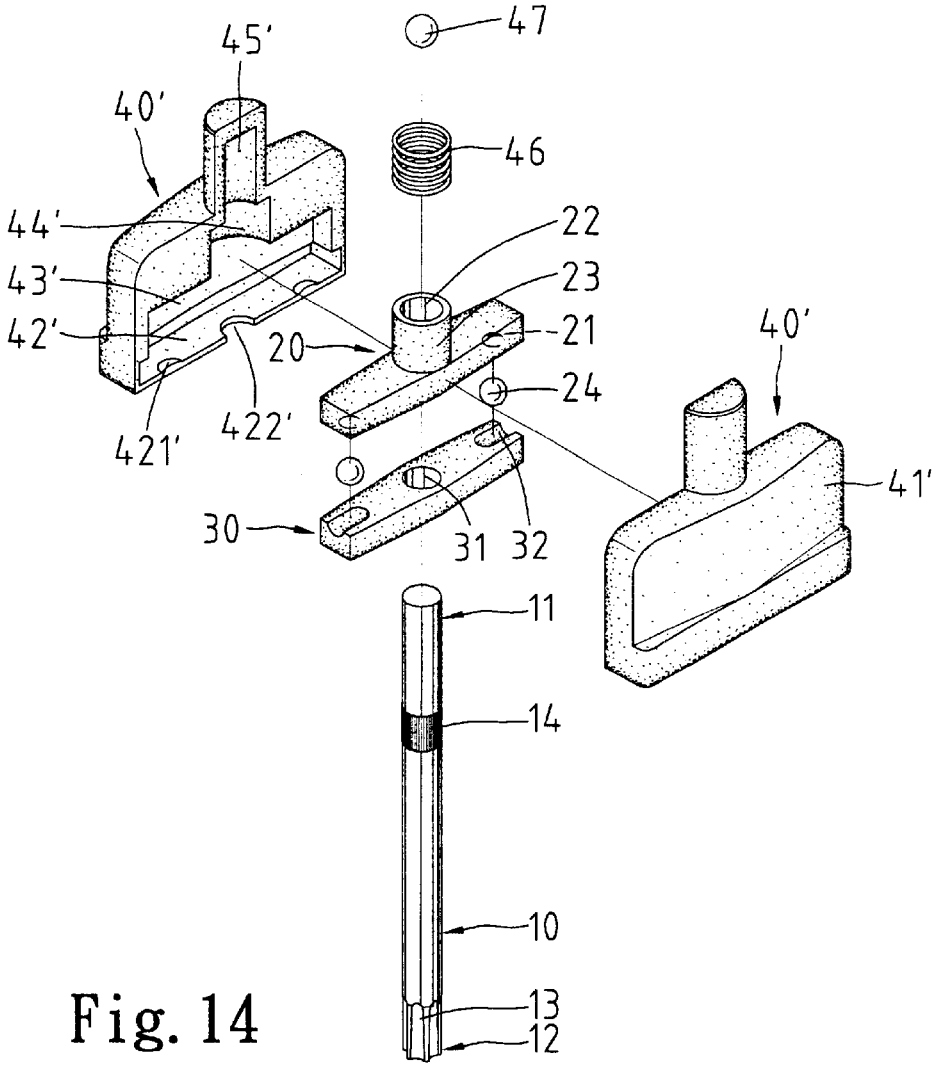
FIG. 14 is an exploded perspective view of the wrench in FIG. 13.
Figure 15A:
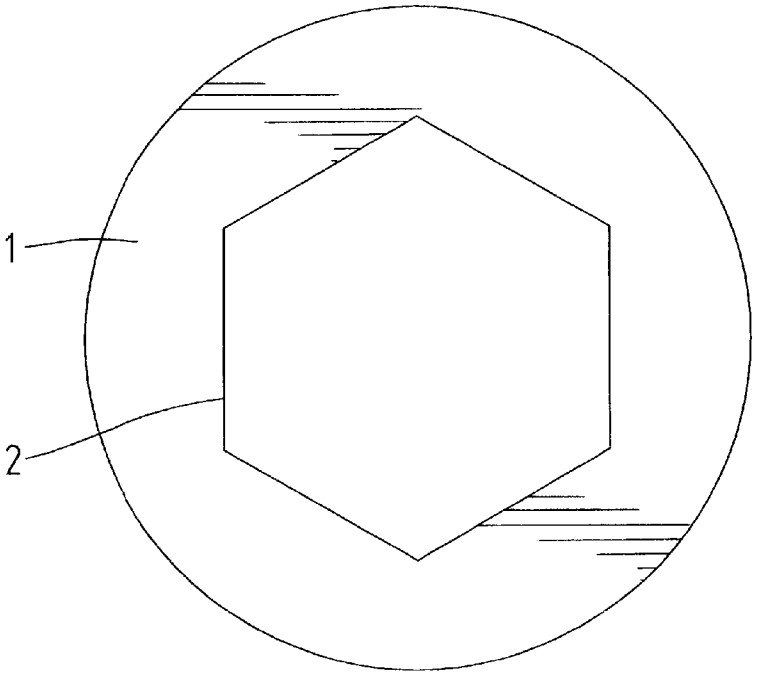
Fig. 15A PRIOR ART
FIG. 15A is an end view of a conventional hexagonal wrench.
Figure 15B:
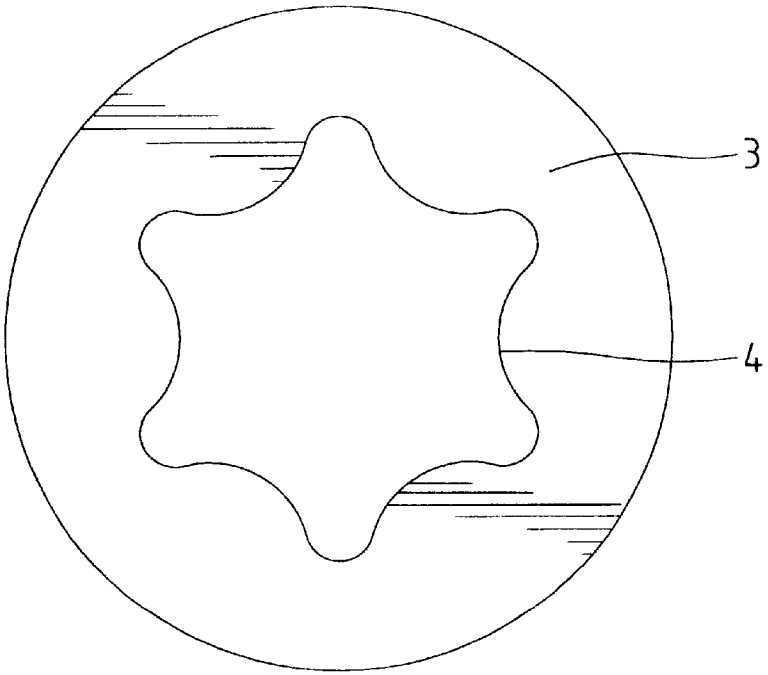
Fig. 15B PRIOR ART
FIG. 15B is an end view of a conventional TROX wrench.
Figure 16:
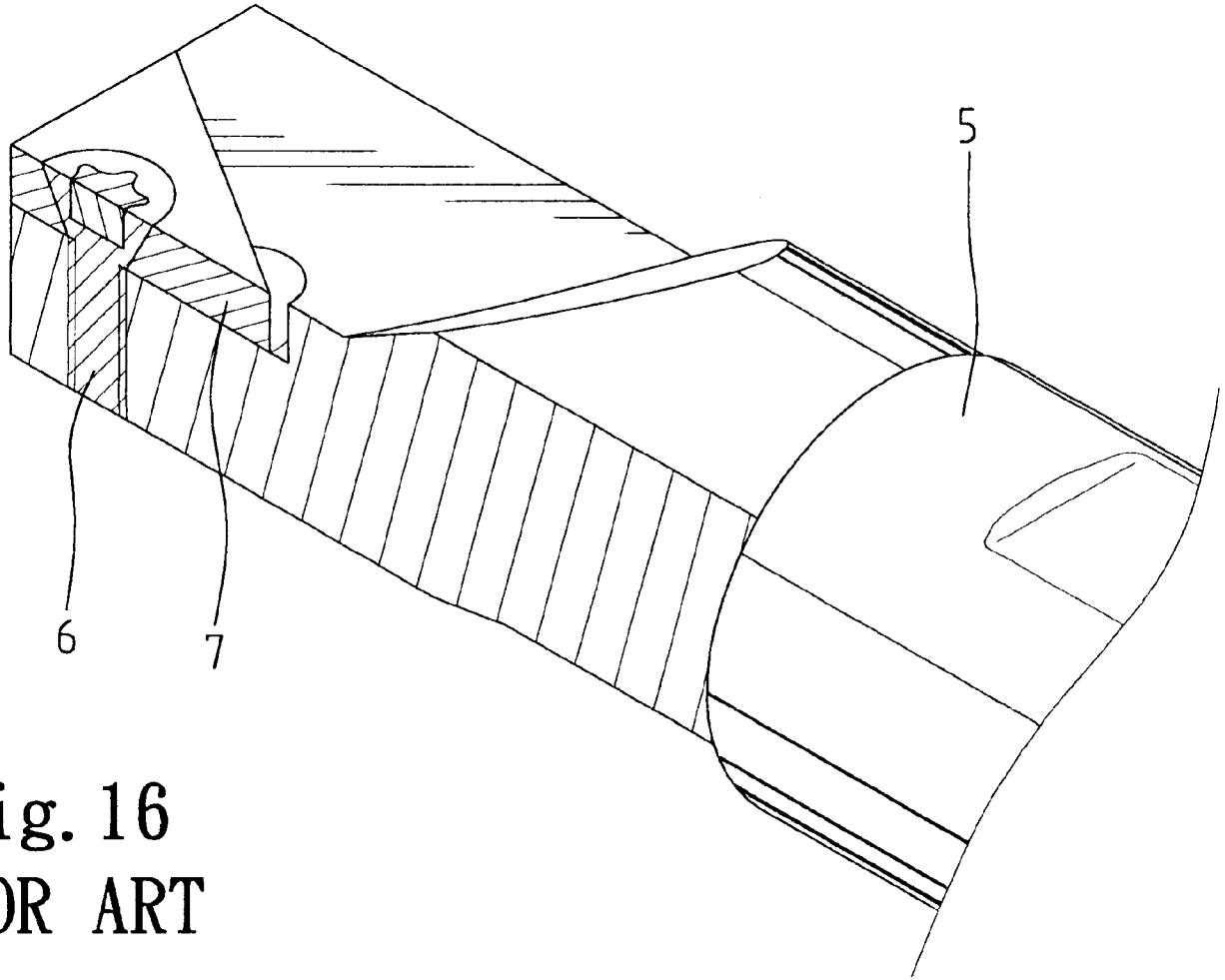
Fig. 16 PRIOR ART
FIG. 16 is a perspective view, partly cutaway, of a cutting tool.

FIG. 14 illustrates another embodiment modified from the first embodiment of the invention, wherein the casing is comprised of two casing halves 40' that together define the receiving section (now designated by 42') for receiving the retainer 30, the compartment (now designated by 43') for receiving the pressing member 20, the positioning hole (now designated by 45') for receiving the first end 11 of the rod 10 and the ball 47. The casing further includes a grasp portion 41' and a notch 422' to accommodate the rod 10 and a notch 421' to accommodate the ball 24. The positioning hole 45' includes an enlarged section 44' for receiving the elastic element 46 and the extension 23 of the pressing member 20. Operation of this embodiment is identical to that of the first embodiment.

Figure 9:
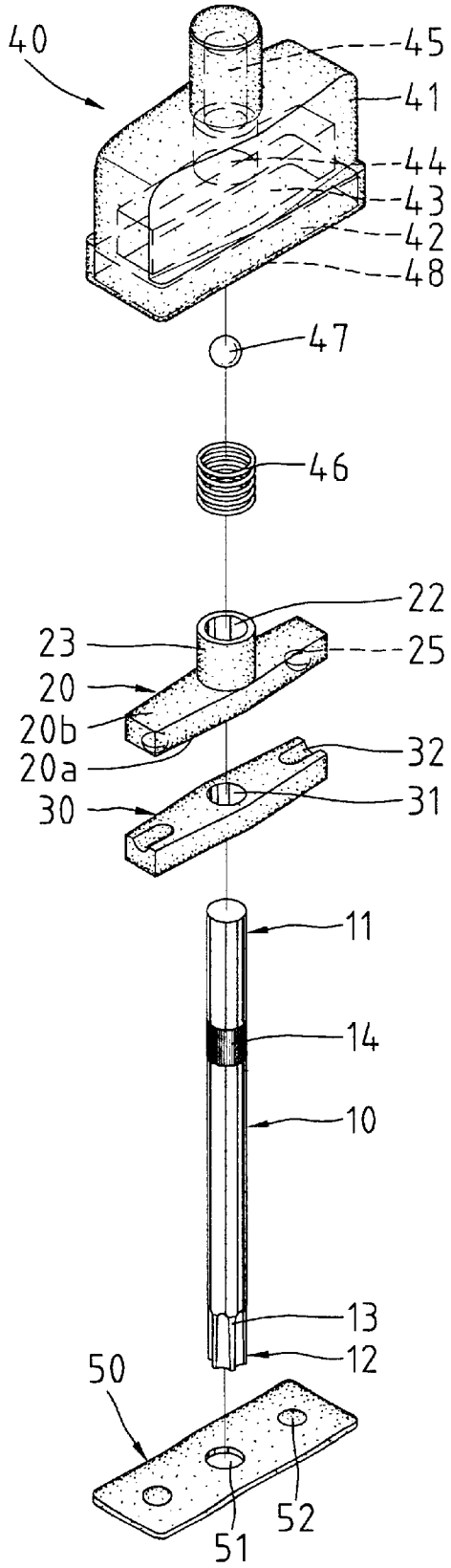
FIG. 9 is an exploded perspective view of a modified embodiment of the wrench in accordance with the present invention.

The casing 40 in the second embodiment of FIG. 9 may be formed of two casing halves 40' in the third embodiment.

Although the invention has been explained in relation to its preferred embodiment, it is to be understood that many other possible modifications and variations can be made without departing from the scope of the invention as hereinafter claimed.

What is claimed is:

1. A wrench comprising:

a rod comprising a driving portion on an end thereof for engaging with a fastener;

a retainer having a central portion securely mounted to the rod to turn therewith and two ends;

a casing comprising a receiving section for accommodating the retainer and allowing relative pivotal movement between the casing and the retainer, the casing further comprising a compartment communicated with the receiving section;

a pressing member received in the compartment of the casing and slidable along a longitudinal direction of the rod, the pressing member being turned together with the casing when the casing is turned;

means for biasing two ends of the pressing member to respectively engage with the ends of the retainer, thereby exerting an engaging force between each of the ends of the retainer and an associated one of ends of the pressing member;

wherein when a rotational force applied to the casing is smaller than the engaging force, the retainer and the rod are turned to thereby turn the fastener; and wherein when a rotational force applied to the casing is greater than the engaging force, the casing and the pressing member slide while the retainer and the rod are not turned.

2. The wrench as claimed in claim 1, wherein each of the ends of the retainer includes a first groove, each of the ends of the pressing member including a second groove, further comprising a ball that is located between the first groove and the second groove, the ball being biased by the biasing means to press against a bottom wall defining an associated one of the first grooves of the retainer.

3. The wrench as claimed in claim 2, wherein the central portion of the retainer has a hole through which the rod extends.

4. The wrench as claimed in claim 3, wherein the rod comprises an embossed section that is securely engaged in the hole of the retainer.

5. The wrench as claimed in claim 1, wherein the casing comprises a positioning hole for receiving another end of the rod, the positioning hole being communicated with the compartment and the receiving section of the casing.

6. The wrench as claimed in claim 5, further comprising a ball mounted between an end face of said another end of the rod and an end wall defining a portion of the positioning hole.

7. The wrench as claimed in claim 5, wherein the positioning hole of the casing comprises an enlarged section, the pressing member including an extension projecting from a side thereof, the extension being slidably received in the enlarged section of the positioning hole, the biasing means being an elastic element mounted around the extension and having a first end attached to an end face defining the enlarged section of the positioning hole and a second end attached to the side of the pressing member.

8. The wrench as claimed in claim 1, wherein the casing comprises a grip portion.

9. The wrench as claimed in claim 1, wherein the casing is comprised of two casing halves.

10. The wrench as claimed in claim 1, further comprising a lid for closing the receiving section.

11. The wrench as claimed in claim 10, wherein the lid comprises a hole through which the rod extends.

12. The wrench as claimed in claim 11, wherein the lid includes two protrusions for supporting the retainer, thereby allowing smooth rotation of the casing relative to the retainer.

13. The wrench as claimed in claim 10, wherein the casing is comprised of two casing halves and wherein the lid is integrally formed with the casing halves.

14. The wrench as claimed in claim 1, wherein the casing comprises a recessed portion surrounding the receiving section, further comprising a lid mounted in the recessed portion for closing the receiving section.

15. The wrench as claimed in claim 14, wherein the lid includes two protrusions for supporting the retainer, thereby allowing smooth rotation of the casing relative to the retainer.

16. The wrench as claimed in claim 1, wherein the pressing member includes two protrusions on a side thereof, each of the ends of the retainer including a groove, each said protrusion being biased by the biasing means to press against a bottom wall defining an associated one of the grooves of the retainer.

17. The wrench as claimed in claim 16, wherein the casing comprises a positioning hole for receiving another end of the rod, the positioning hole being communicated with the compartment and the receiving section of the casing.

18. The wrench as claimed in claim 17, further comprising a ball mounted between an end face of said another end of the rod and an end wall defining a portion of the positioning hole.

19. The wrench as claimed in claim 18, wherein the casing comprises a grip portion.

20. The wrench as claimed in claim 16, wherein the casing is comprised of two casing halves.

21. The wrench as claimed in claim 16, further comprising a lid for closing the receiving section.

22. The wrench as claimed in claim 21, wherein the lid comprises a hole through which the rod extends.

23. The wrench as claimed in claim 22, wherein the lid includes two protrusions for supporting the retainer, thereby allowing smooth rotation of the casing relative to the retainer.

24. The wrench as claimed in claim 21, wherein the casing is comprised of two casing halves and wherein the lid is integrally formed with the casing halves.

25. The wrench as claimed in claim 16, wherein the casing comprises a recessed portion surrounding the receiving section, further comprising a lid mounted in the recessed portion for closing the receiving section.

26. The wrench as claimed in claim 25, wherein the lid includes two protrusions for supporting the retainer, thereby allowing smooth rotation of the casing relative to the retainer.

27. The wrench as claimed in claim 16, wherein the positioning hole of the casing comprises an enlarged section, the pressing member including an extension projecting from a side thereof, the extension being slidably received in the enlarged section of the positioning hole, the biasing means being an elastic element mounted around the extension and having a first end attached to an end face defining the enlarged section of the positioning hole and a second end attached to the side of the pressing member.

* * * * *